US009175485B2

(12) United States Patent
Domage et al.

(10) Patent No.: US 9,175,485 B2
(45) Date of Patent: Nov. 3, 2015

(54) TENSION MEMBER FEEDING DEVICE

(75) Inventors: Jean-Baptiste Domage, Marly le Roi (FR); Denys Bour, Asnieres-sur-Seine (FR)

(73) Assignee: VSL INTERNATIONAL AG, Koniz (CH)

( * ) Notice: Subject to any disclaimer, the term of this patent is extended or adjusted under 35 U.S.C. 154(b) by 0 days.

(21) Appl. No.: 14/236,708

(22) PCT Filed: Aug. 12, 2011

(86) PCT No.: PCT/EP2011/063984

§ 371 (c)(1),
(2), (4) Date: Jun. 5, 2014

(87) PCT Pub. No.: WO2013/023682

PCT Pub. Date: Feb. 21, 2013

(65) Prior Publication Data

US 2014/0291374 A1 Oct. 2, 2014

(51) Int. Cl.

| | |
|---|---|
| ***B63B 35/03*** | (2006.01) |
| ***E04G 21/12*** | (2006.01) |
| ***B21F 23/00*** | (2006.01) |
| ***E04C 5/08*** | (2006.01) |

(52) U.S. Cl.

CPC ..... *E04G 21/12* (2013.01); *B21F 23/00* (2013.01); *B21F 23/005* (2013.01); *E04C 5/08* (2013.01)

(58) Field of Classification Search

USPC ..... 254/134.3 R, 134.6; 29/428, 433

See application file for complete search history.

(56) References Cited

U.S. PATENT DOCUMENTS

| | | | | |
|---|---|---|---|---|
| 3,942,238 | A | 3/1976 | Dore | |
| 4,095,326 | A * | 6/1978 | Harvey | 29/417 |
| 4,728,079 | A * | 3/1988 | Nitta et al. | 254/134.3 FT |
| 4,757,976 | A * | 7/1988 | Langston | 254/134.3 FT |
| 5,331,796 | A * | 7/1994 | Varga | 57/9 |
| 5,559,294 | A * | 9/1996 | Hoium et al. | 73/862.44 |
| 6,877,688 | B2 * | 4/2005 | Jordan et al. | 242/473.5 |

FOREIGN PATENT DOCUMENTS

| | | | |
|---|---|---|---|
| CH | 602219 | A5 | 7/1978 |
| DE | 3021673 | A1 | 12/1981 |
| DE | 3138820 | A1 | 4/1983 |
| DE | 4442483 | A1 | 5/1996 |

OTHER PUBLICATIONS

International Search Report dated Jun. 18, 2012 for PCT/EP2011/063984.

International Preliminary Report on Patentability dated May 22, 2013 for PCT/EP2011/063984.

* cited by examiner

*Primary Examiner* — Lee D Wilson
*Assistant Examiner* — Shantese McDonald
(74) *Attorney, Agent, or Firm* — Pearne & Gordon LLP

(57) ABSTRACT

The present invention concerns a tension member feeding device for feeding a tension member into a channel in a construction element. The feeding device comprises: tension member feeder and a resistance or speed detector. The feeding device is arranged to stop feeding of the tension member once the resistance or speed detector detects that the tension member meets a given resistance.

17 Claims, 1 Drawing Sheet

TENSION MEMBER FEEDING DEVICE

TECHNICAL HELD

The present invention relates to a device to be used in inserting individual tension elements, such as strands, into a tubular channel. Such tubular channels, generally known as ducts, made of plastic or metal, are located in concrete elements that are used in numerous construction works. The invention also relates to a corresponding tension element feeding system and to a method of feeding a tension element into a tubular channel.

BACKGROUND OF THE INVENTION

Tension members, such as prestressing tendons, are used to overcome concrete's natural weakness in tension. The method of prestressing concrete is used to produce beams, floors or bridges with a longer span than is practical with ordinary reinforced concrete. This method has also been extended to large civil work structures like tanks, dams and nuclear containments. Traditional reinforced concrete is based on the use of steel reinforcement bars (rebars) inside poured concrete. Prestressing tendons, generally composed of tensile cables made of high strength steel strands or rods, are used to provide a clamping force which produces a compressive stress on the concrete member to offset the tensile stress that the concrete member would otherwise experience due to an applied load.

The prestressing tendons are generally made up of a plurality of wires, bars or strands, the strands being further made up of several twisted metal wires. Known strands used in prestressing tendons are generally made up of metallic wires, for example steel wires. In some applications these wires are twisted together, and are coated with a protective filler and wrapped in a protective sheath of polymeric material, which may be extruded around the bundle of twisted-together wires.

Prestressed concrete can generally be accomplished in three ways: pre-tensioned concrete, and bonded or unbonded post-tensioned concrete.

Prestressed concrete by pretensioning is obtained by casting concrete around already tensioned tendons. This method produces a good bond between the concrete and tendon, with concrete protecting the tendon from corrosion and allowing for direct transfer of tension. The cured concrete can then adhere and bond to the tendons, and when the tension is released, the compressive stress is transferred to the concrete by bond. However, this method requires stout anchoring points between which the tendon is to be stretched, and the tendons are usually in a straight line. No ducts are needed for the tendons.

Prestressed concrete by applying the method of bonded post-tensioned concrete comprises applying compression after pouring concrete and the curing process (in situ). The concrete is cast around a plastic or steel duct (often curved). In follow the area where otherwise tension would occur in the concrete element. A set of tendons is fed through the duct, and the concrete is poured. The tendons may also be fed after pouring the concrete. Once the concrete has hardened, the tendons are tensioned by e.g. hydraulic jacks that react against the concrete member itself. When the tendons have stretched sufficiently, according to the design specifications, they are wedged in position so that the tension is maintained after the jacks are removed and the pressure is transferred to the concrete through the anchoring elements. Finally the duct is then filled with a hardening protective filler such as grout to protect the tendons from corrosion and to provide bond. This method is commonly used to create monolithic slabs for building construction and in the construction of various types of bridges.

Unbonded post-tensioned concrete differs from bonded post-tensioning by providing tendons with permanent freedom of movement relative to the concrete. To achieve this, according to one solution each individual tendon or strand is coated with a layer of grease (usually lithium-based) and covered by a plastic sheathing formed in an extrusion process. These coated and sheathed tendons are either placed directly inside the concrete or alternatively inside a duct which is finally filled with a hardening protective filler such as grout. Alternatively, non-coated and non-sheathed tendons (same as for bonded post-tensioned concrete above) may be installed inside the duct which then may be filled with a flexible protective filler such as grease or wax to prevent bond.

In post-tensioning methods, difficulties often arise when feeding tension members into a duct. The feeding operation is generally done by feeding devices specifically designed for this purpose. When tension members are individually fed into a duct, then they are generally pushed by the feeding device, also known as a strand pusher. The ducts can be very long and curved. Especially in these situations the tension member can get blocked inside the duct. This can be very problematic, especially if there is a protective sheathing around the tension member. In this case, the feeding device can damage the protective sheathing when trying to push the blocked tension member further into the duct. Tension members with a damaged sheathing are prone to corrosion before the filling of the duct with a protective filler is completed. Furthermore, the damaged sheathing may make it impossible to replace these tension members later. If the protective sheathing gets damaged, then often the whole tension member feeding operation has to be started again with a tension member having an undamaged protective sheathing.

It is the object of the present invention to overcome the problems identified above related to the feeding of tension members into ducts.

SUMMARY OF THE INVENTION

According to a first aspect of the invention, there is provided a tension member feeding device as recited in claim 1.

Thus, once the tension member has met a certain resistance, e.g. is blocked, the feeding operation is automatically stopped and thus any damage to the protective sheathing of the tension member can be avoided. This has the further advantage that the feeding operation does not have to be started all over again. Once the feeding is stopped after a blockage has been detected, the tension member can be pulled back slightly or completely and then the feeding operation can be continued. Thus, as the protective sheathing is not damaged, this has therefore the advantage that the tension member can be protected against corrosion. This is especially advantageous for the corrosion protection of the tension member during the time period when the channel is not yet filled with protective filler because during that time period the prestressing tension member is especially vulnerable to corrosion due to the absence of the protective filler.

According to a second aspect of the invention, there is provided a tension member feeding system as recited in claim 10.

According to a third aspect of the invention, there is provided a method of feeding a tension member into a channel as recited in claim 16.

Other aspects of the invention are recited in the dependent claims attached hereto.

BRIEF DESCRIPTION OF THE DRAWINGS

Other features and advantages of the invention will become apparent from the following description of a non-limiting exemplary embodiment, with reference to the appended drawings, in which.

DETAILED DESCRIPTION OF AN EMBODIMENT OF THE INVENTION

Figure 1:
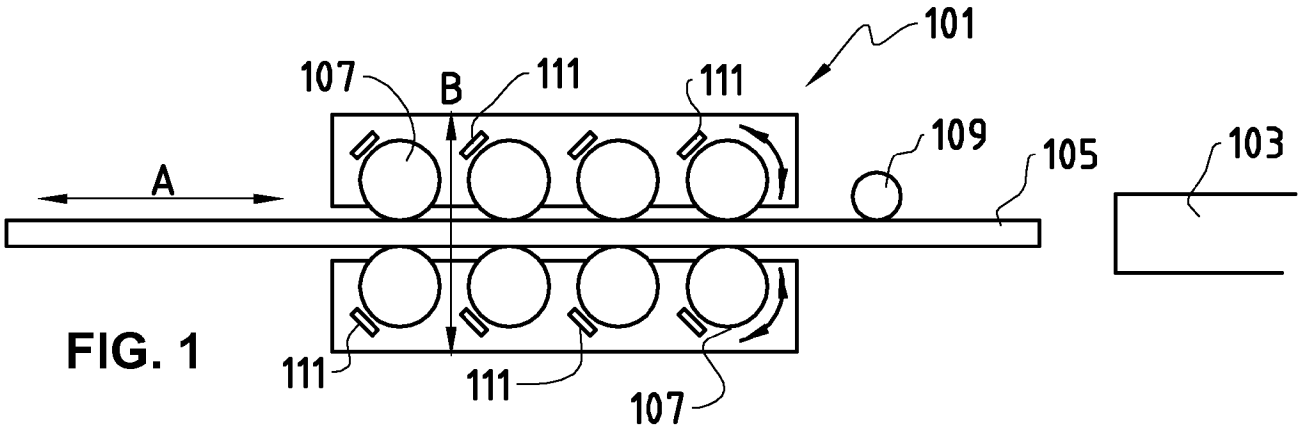
FIG. 1 is a simplified perspective side view of a tension member feeding device according to one example of the present invention.

An embodiment of the present invention will be described in the following in more detail with reference to the attached figures. Identical functional and structural elements which appear in the different drawings are assigned the same reference numerals.

FIG. 1 is a simplified side view showing a tension member feeding device 101 according to the first example of the present invention. The feeding device is arranged to feed tension members 105, such as strands, individually into a channel 103, such as a duct, located in a concrete structure, for instance. The tension member 105 is pushed by the feeding device 101 in its longitudinal direction into the duct 103. The arrow A in FIG. 1 illustrates the direction of movement of the tension member 105 when it passes through the feeding device 101. In this figure, the tension member moves to the right when it is normally fed into the duct 103.

The tension member 105 can be fed through the duct 103 either before the concrete is poured around the duct 103 or, alternatively, the tendon 105 can be fed through the duct 103 after this, even after the concrete has hardened. In one specific example, the feeding length is around 160 m on a 367° horizontal circular shape with vertical deviation going up to 6 m. Between the feeding device 101 and the duct 103, there can be a guiding device for guiding the tension member 105 into the duct 103.

The duct 103 can be made of steel pipe, steel sheet or thermoplastic polymer, such as high density polypropylene (HDPP) or high density polyethylene (HDPE). The concrete, which is not shown in the figures, is cast around the duct 103. The tension member that is fed inside the concrete structure can then be post-tensioned and the duct can be grouted. In the example described below, the tension member 105 is sheathed, for example with a HDPE or other material (HDPP, epoxy). The sheathing makes it possible to achieve unbonded post-tensioning by filling the duct 103 with a grout after all the tension members are pushed through the duct 103. Thus, thanks to the sheathing, the tension members 105 can be replaced or re-stressed individually if needed, even after hardening of the grouting. The tension members 105 can also be monitored. The sheathed tension member 105 can also be filled with a lubricant such as grease or other to reduce friction between the tension member and the sheathing and to improve corrosion protection.

The sheathed tension member 105 is normally wound onto a reel, or pre-cut in a prefabrication area or placed in a unwinding tool which is not illustrated in the figures, but in the figures it would be located on the left from the feeding device 101. From this reel the tension member 105 can be pulled by the feeding device 101 while at the same time the tension member 105 is pushed into the duct 103.

The feeding device 101 has tension member feeding means 107, which in this example are rollers 107 covered with soft material that are pressed on the tension members 105. In FIG. 1 eight rollers 107 are shown, two sets of four rollers each 107 facing each other on the opposite sides of the tension member 105. The rollers 107 that face each other can be synchronised. The number of the rollers is of course not limited to eight. The rollers 107 are arranged to move vertically in the figure, as illustrated by the arrow B, so that the pressure exerted on the tension member 105 can be adjusted. The rollers 107 can have a groove that fits the tension member 105.

The feeding device 101 is arranged so that the tension member 105 can be fed into this device from the longitudinal ends (left or right ends in FIG. 1) or from the lateral side (the exposed side seen in FIG. 1) of the feeding device 101. The possibility of inserting the tension member 105 from the side of the feeding device 101 is also useful, since the feeding device 101 may be located halfway through the threading distance, for example in the case where it is used for vertical inverted U-shaped tendons. This is the case e.g. with bridge saddles and some nuclear containment design. In this situation, one of the feeding devices 101 can be located high above the ground level and the tension member 105 can be fed into the feeding device 101 from an intermediate location along the tension member 105.

The rollers 107 are run by a motor, which is not illustrated in the figures. This motor can be an electrical motor or a hydraulic motor. In case of a hydraulic motor, it is powered by a hydraulic pump that itself can actually be located physically in a separate location from the feeding device 101. The motor provides adjustable power so that the force (pushing force) applied by the rollers 107 to the tension member 105 can be adjusted, and thus the feeding speed of the tension member 105 is also adjustable. The feeding speed is typically between 0.5 m/s and 12 m/s, and in certain applications it is 7 m/s. The possibility to have the feeding device 101 and the hydraulic pump apart makes it possible to have the hydraulic pump on the ground when pushing tension members 105 at a higher level. The performance of the feeding device 101 remains the same with e.g. 70 m height difference between the hydraulic pump and the feeding device 101. The feeding device has sufficient power to be placed at a certain distance from the duct 103. In this case a special guiding tool is used between the feeding device 101 and the entrance of the duct 103. This can be done for a distance up to 50 m. An integrated brake prevents the tension member 105 from going backwards. The feeding device 101 can also have adequate lifting eyes or hooks for handling and lifting.

In FIG. 1 also shown are resistance detection means 109 and brakes 111, which are arranged to brake the tension member 105 when necessary. The detection means (which can also be called tension member blockage or resistance detection means) 109 may or may not be part of the feeding device 101. The detection means 109 can be placed before or after the feeding device 101 or directly connected to the motor or to one or several rollers 107. In the example illustrated in FIG. 1, the detection means 109 are part of the feeding device 101, and are located in front of the feeding means 107, between the duct 103 and the feeding means 107. The detection means 109 can be implemented in several ways. Examples of different detection means 109 are for instance:

- Tension member speed detection means, such as a light sensor or a rotating wheel on the tension member;
- Peak hydraulic pressure sensor in the case of a hydraulic motor;

Amperage sensor in the case of an electrical motor;
Vibration sensor; and
Accelerometer.

Once the detection means 109 detect that that the tension member 105 has met a given resistance, e.g. has been blocked and thus stopped, then the feeding device 101 activates a stopping of the pushing of the tension member 105. This has the advantage, for instance, that any damage to the sheathing of the tension member 105 can be avoided in the feeding device 101. The stopping of the pushing can also be triggered if a deceleration of the tension member is detected by the tension member speed detection means. Thus, the feeding device 101 has an ability to disengage automatically when resistance is met. In traditional strand pushers, if the tension member gets stopped somewhere in the duct and the strand pusher keeps on pushing, it will damage the sheathing. Then all the length that has been pushed into the duct is lost. Thus, in the present invention, the ability of automatically disengaging when a jam or blockage in the tension member travel path is detected brings important advantages.

The stopping of the pushing can be done, for instance, by:
Cutting off the hydraulic power flow rate (e.g. oil) in the case of a hydraulic motor;
Cutting off the electrical power in the engine arranged to run the feeding means 107 in the case of an electrical motor;
Activating the brakes 111 in the feeding device 101; and
Disengaging the tension member 105 by the feeding device 101 unclamping the tension member 105.

The detection of the stopping of the tension member 105 and the stopping action at the feeding device 101 can involve the different means listed above separately or in combination. For instance, there is no need for a speed sensor if the stopping of the tension member 105 is based only on the peak hydraulic pressure sensor or amperage sensor. Also, no brakes may be needed if the stopping of the pushing is done only by cutting off the hydraulic or electric power. In one example, if the brakes are used, and when the feeding device 101 is about to start or restart pushing of the tension member 105, then the feeding device 101 can be arranged to gradually release the brake when the pressure sent to the hydraulic motor driving the rollers exceeds a preset value. As is evident for a skilled person, several possibilities exist with respect to choice of the detection means and of how to stop the pushing of the tension member 105.

Furthermore, the feeding device 101 can be designed so that in any case the pushing force cannot damage the sheathing of the tension members 105. The torque for the motor can be adjusted to feed the tension member 105 at the desired rate.

The feeding device 101 can have the following specifications:
Threading speed: 3 speeds for forward operation (slow, medium, and fast, fast being e.g. 7 m/s) and 2 speeds (slow, medium) for backward operation;
Counter: A distance counter device can be mounted on the pushing head of the tension member in order to determine the length that has been threaded;
Automatic stop: The automatic stop can be arranged to activate when a certain distance of the tension member has been threaded;
Pushing force: >3500 N;
Power: electrical: 22 KW, 64 A, 230 V or 400 V, 3 phases;
Pushing direction: Both;
Working temperature: From −40° C. to +60° C., and
Remote control: Operable to a certain distance, e.g. 100 m.

Figure 2:
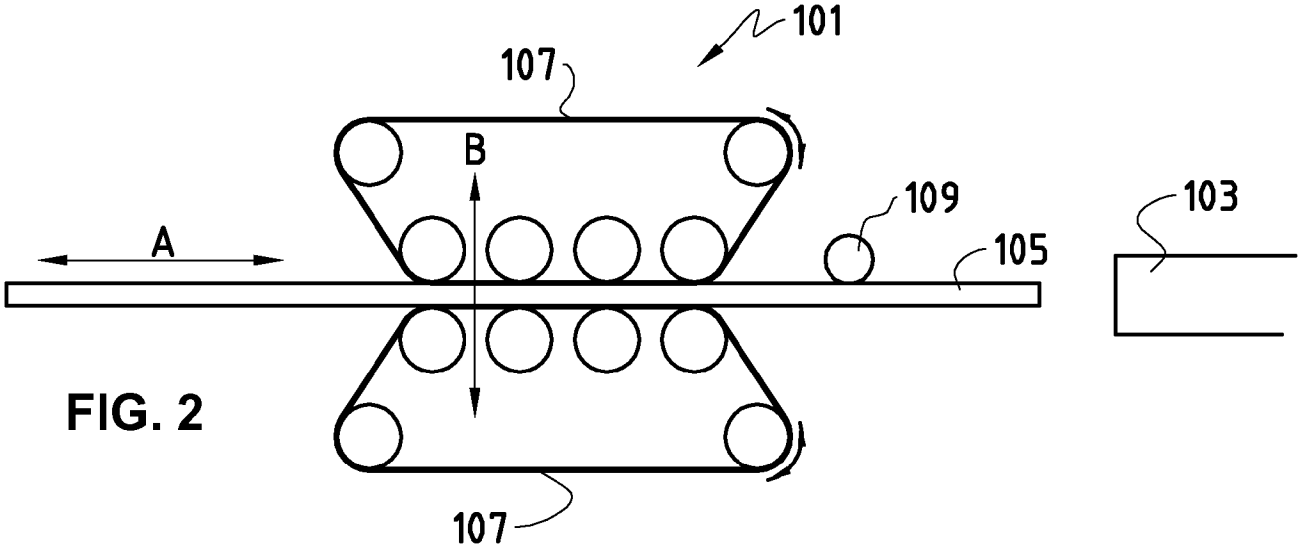
FIG. 2 is a simplified perspective side view of a tension member feeding device according to another example of the present invention.

FIG. 2 is a simplified side view showing a tension member feeding device 101 according to the second example of the present invention. The feeding device 101 according to this example has the same properties as the feeding device according to the first example. Structurally they are also very similar. The only difference is that instead of having individual rollers that push the tension member 105, the feeding device is equipped in this example with two opposed bands, made of soft material, which are powered by several wheels.

While the invention has been illustrated and described in detail in the drawings and foregoing description, such illustration and description are to be considered illustrative or exemplary and not restrictive, the invention being not limited to the disclosed embodiment. Other embodiments and variants are understood, and can be achieved by those skilled in the art when carrying out the claimed invention, based on a study of the drawings, the disclosure and the appended claims.

In the claims, the word "comprising" does not exclude other elements or steps, and the indefinite article "a" or an does not exclude a plurality. The mere fact that different features are recited in mutually different dependent claims does not indicate that a combination of these features cannot be advantageously used. Any reference signs in the dams should not be construed as limiting the scope of the invention.

The invention claimed is:

1. A tension member feeding device for feeding a tension member into a channel, the feeding device comprising:
a tension member feeder; and
a resistance or speed detector,
wherein the feeding device is arranged to stop feeding of the tension member once the resistance or speed detector detects that the tension member meets a predetermined resistance or detects a change of speed of the tension member.

2. A tension member feeding device according to claim 1, wherein the feeding of the tension member is stopped once the resistance or speed detector detects that the tension member has been blocked.

3. A tension member feeding device according to claim 1, wherein the feeding device further comprises a controller that controls the force applied by the tension member feeder to the tension member.

4. A tension member feeding device according to claim 3, wherein the controller is arranged to limit to a predetermined value the maximum force applied by the tension member feeder to the tension member.

5. A tension member feeding device according to claim 1, wherein the resistance or speed detector is at least one of the following: a tension member speed detector, a peak hydraulic pressure sensor, an amperage sensor, a vibration sensor and an accelerometer.

6. A tension member feeding device according to claim 5, wherein the detector is a tension member speed detector, wherein the tension member speed detector is a light sensor or a rotating wheel on the tension member.

7. A tension member feeding device according to claim 1, further comprising brakes arranged to act on the tension member when the resistance or speed detector detects that the tension member has met a predetermined resistance.

8. A tension member feeding device according to claim 1, wherein the feeding is stopped by disengaging the tension member by the feeding device unclamping the tension member.

9. A tension member feeding device according to claim 1, wherein the tension member feeder comprises
rollers arranged on at least two sides of the tension member, and arranged to rotate, thereby pushing the tension member;

or at least two bands arranged to rotate, thereby pushing the tension member.

10. A tension member feeding system comprising the tension member feeding device according to claim 1, and further comprising a hydraulic or an electric motor arranged to run the tension member feeder, and wherein the feeding of the tension member is stopped by cutting off the hydraulic power flow rate in the hydraulic motor or cutting off the electrical power in the electric motor.

11. A tension member feeding system according to claim 10, wherein the motor is a hydraulic motor, wherein the hydraulic motor comprises a hydraulic pump located physically in a different place from the feeding device, or wherein the hydraulic pump and the feeding device are located physically at the same location.

12. A tension member feeding system according to claim 10, wherein the tension member feeding system further comprises a sheathed tension member.

13. A tension member feeding system according to claim 12, wherein the tension member has a distance counter for measuring the length of the part of the tension member that has been fed by the feeding device.

14. A tension member feeding system according to claim 13, wherein the feeding device has an automatic stop arranged to stop the pushing of the tension member when a predetermined length of the tension member has been fed as indicated by the distance counter.

15. A tension member feeding system according to claim 10, wherein the tension member feeder is arranged to move vertically to clamp and unclamp the tension member allowing thereby insertion of the tension member from the lateral side into the feeding device and removal of the tension member from the feeding device from the lateral side of the feeding device.

16. A method for a tension member feeding device to feed a tension member into a channel, the method comprising:

feeding power to the feeding device;

pushing the tension member into the channel;

detecting that the tension member meets a predetermined resistance or detecting a change of speed of the tension member; and stopping the pushing of the tension member based on the detection of the resistance or change of speed.

17. The method of claim 16, wherein the channel is within a concrete civil work structure.

* * * * *